United States Patent [19]

Wong et al.

[11] Patent Number: 4,458,217

[45] Date of Patent: Jul. 3, 1984

[54] SLOT-COUPLED MICROWAVE DIPLEXER AND COUPLER THEREFOR

[75] Inventors: Mon N. Wong, Torrance; Frank A. Taormina, Glendale, both of Calif.

[73] Assignee: Hughes Aircraft Company, El Segundo, Calif.

[21] Appl. No.: 308,307

[22] Filed: Oct. 5, 1981

[51] Int. Cl.[3] ..... H01P 1/213; H01P 5/103

[52] U.S. Cl. ..... 333/135; 333/126; 333/26

[58] Field of Search ..... 333/26, 21 R, 33, 122, 333/125-127, 134-137

[56] References Cited

U.S. PATENT DOCUMENTS

| | | | |
|---|---|---|---|
| 3,528,041 | 9/1970 | Honda et al. | 333/26 |
| 3,725,824 | 4/1973 | McDonald | 333/21 R |
| 4,139,828 | 2/1979 | Commault et al. | 333/26 |
| 4,168,478 | 9/1979 | Schuegraf | 333/135 |

FOREIGN PATENT DOCUMENTS

| | | | |
|---|---|---|---|
| 1059986 | 6/1959 | Fed. Rep. of Germany | 333/26 |

*Primary Examiner*—Paul L. Gensler

*Attorney, Agent, or Firm*—C. L. Anderson; W. J. Benman; A. W. Karambelas

[57] ABSTRACT

A compact power coupler comprises a first waveguide short-circuited at one end, a resonant cavity slot-coupled to the shorted end of the first waveguide, and a coaxial transmission line coupled to the resonant cavity. Power at 6 gigahertz is coupled from the waveguide to the transmission line in a unit that is 3.5 inches long. Alternatively, a second waveguide can be slot-coupled to a narrow-wall of the first waveguide (a quarter-wavelength from the short-circuit) to couple 4 gigahertz power, thereby forming a compact diplexer.

10 Claims, 7 Drawing Figures

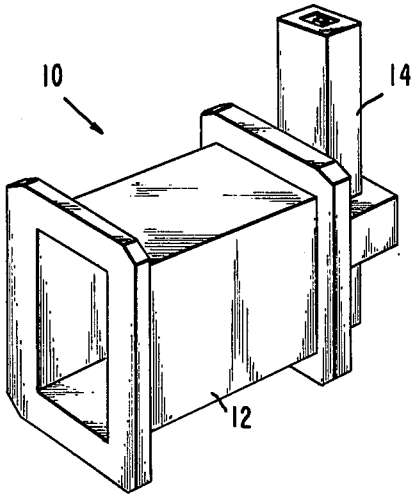
Fig. 1.
Fig. 2.
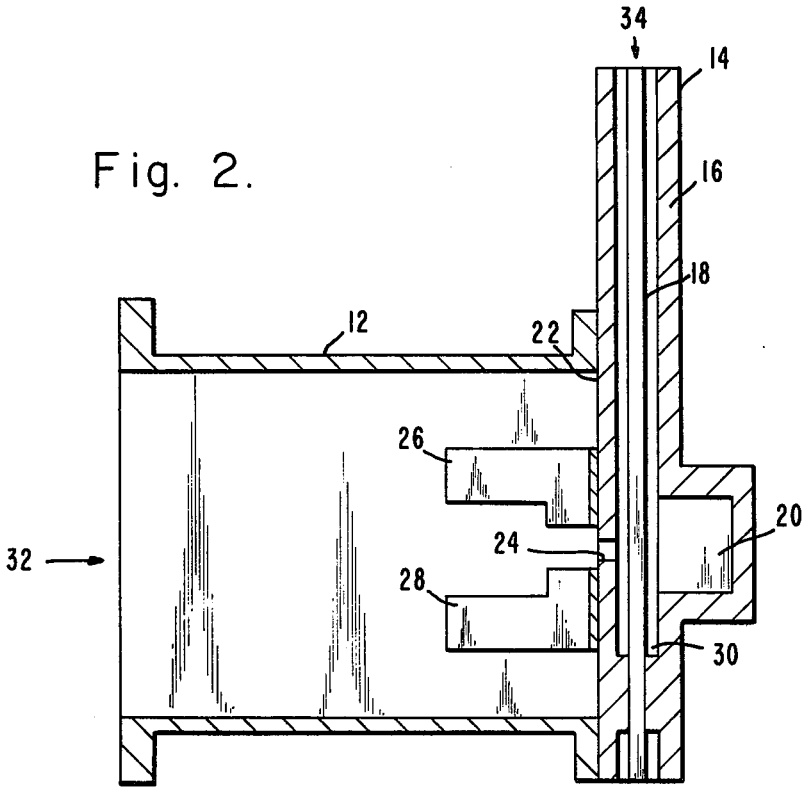

SLOT-COUPLED MICROWAVE DIPLEXER AND COUPLER THEREFOR

BACKGROUND OF THE INVENTION

1. Field of the Invention

This invention relates to the field of power couplers and diplexers. More particularly, the invention relates to a compact waveguide-to-transmission line power coupler and a compact diplexer.

2. Description of the Prior Art

Satellites in earth orbit frequently utilize the same antenna for both transmitting and receiving signals from earth. The frequencies of the transmit signal and the received signal are usually different in such a case to avoid interference between signals. For example, the transmit frequency may be 4 gigahertz, while the signal received by the satellite antenna is 6 gigahertz. Each signal will originate from or be conducted to different equipment within the satellite, so it is necessary to have a three-port component coupling microwave power between the common antenna, and the transmit and receive equipment. This three-port component is usually called a diplexer. It must be capable of efficiently isolating the transmit and receive signals from one another and, for obvious reasons, it should be as light and compact as possible.

Diplexers are generally known and various arrangements have been used aboard satellites in the past. These prior art diplexers have been as short as 6 inches in length and have achieved acceptable isolation between transmit and receive frequencies. For example, one prior art diplexer consists of a first waveguide coupled at one end thereof to a second waveguide, and slot-coupled to a third waveguide through a narrow-wall of the first waveguide. The first waveguide is coupled to the second waveguide through a stepped impedance transformer. This prior art diplexer is relatively large and heavy because of the presence of the stepped impedance transformer. It would be desirable to have a diplexer that is much more compact than prior art devices while providing even better signal isolation.

SUMMARY OF THE INVENTION

It is a purpose of this invention to provide a new and improved diplexer which overcomes the above-described problems of the prior art diplexers, and which is operable to couple a signal received by an antenna in the proper equipment, and to couple a signal generated within a satellite to the antenna.

It is also a purpose of this invention to provide a highly compact diplexer that achieves excellent isolation between transmit and receive signals.

It is a further purpose of this invention to couple power between ports as efficiently and as compactly as possible.

To accomplish these purposes while overcoming the disadvantages of the prior art described above, the present invention provides a compact microwave power coupler having a first waveguide with a short-circuit at one end, a cavity which is resonant at a chosen design frequency and slot-coupled to the shorted end of the first waveguide, and a coaxial transmission line coupled to the resonant cavity. In another embodiment of the invention this power coupler is modified to form a compact diplexer by the provision of a second waveguide which is slot-coupled to a narrow-wall of the first waveguide.

One of the advantages of this invention is that it is relatively compact and lightweight compared to the prior art diplexer described previously. This is an important advantage in satellite applications. Another advantage is that the coupling slot at the shorted end of the first waveguide of this invention rejects undesirable frequencies better than the prior art stepped impedance transformer.

BRIEF DESCRIPTION OF THE DRAWINGS

FIG. 1 is a perspective view of a compact power coupler according to one embodiment of this invention.

FIG. 2 is a sectional view of the embodiment of this invention depicted in FIG. 1.

DETAILED DESCRIPTION OF THE INVENTION

Figure 3:
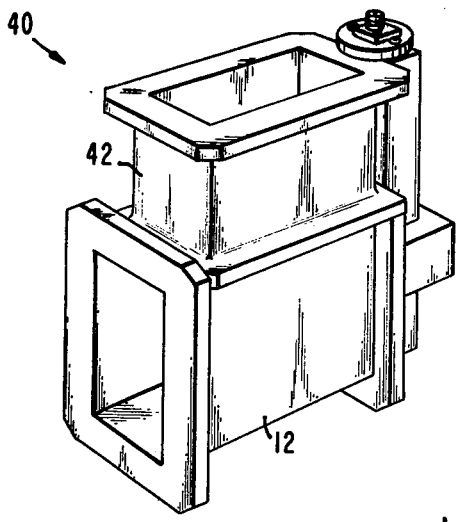
FIG. 3 is a perspective view of a compact power coupler according to a second embodiment of this invention.

The compact power coupler 10 shown in FIG. 1 comprises a first rectangular waveguide 12 and a square coaxial TEM transmission line 14. This power coupler 10 is 1.145 inches wide and 3.5 inches long. The first waveguide section 12 is 2.29 inches high and the transmission line portion 14 extends approximately 2 inches above the first waveguide section 12. The transmission line portion 14 could, of course, be somewhat shorter.

The power coupler 10 is shown in more detail in FIG. 2. The first waveguide 12 is attached securely to the transmission line 14 by bolts (not shown) or other suitable means. The transmission line 14 has an outer conductor 16 and an inner conductor 18. The inner conductor 18 and the inner wall of the outer conductor 16 are both square in cross-section and have the same axis.

The outer conductor 16 is shaped to form a cavity 20 behind the inner conductor at a section of the transmission line 14 lying behind the first waveguide 12 and centered on the longitudinal axis thereof. The cavity 20 is deeper and wider than the cross-sectional area of the transmission line 14. The section 22 of the outer conductor 16 that extends as shown between the top and bottom walls of the first waveguide 12 effectively short-circuits any electromagnetic energy that propagates through the first waveguide 12. Therefore, it can be called the waveguide short-circuit 22. There is a first slot 24 in the waveguide short-circuit 22, and its resonant design frequency is 6 gigahertz. ("6 GHz" refers herein to the frequency range of approximately 5.925 GHz to 6.425 GHz, unless otherwise indicated by context. Similarly, "4 GHz" refers to the frequency range of approximately 3.7 GHz to 4.2 GHz.) The first slot 24 is oriented parallel to the plane of the narrow-walls of the first waveguide 12 and is bisected by the first waveguide's longitudinal axis. Two thin-wall stepped transformers 26 and 28 are mounted on the surface of the waveguide short-circuit 22. The transmission line 14 is terminated as shown at its lower end by a shorted stub 30.

The power coupler 10 is designed to couple electromagnetic energy having a frequency of approximately 6 gigahertz from the input/output port 32 of the first waveguide 12 to the input/output port 34 of the transmission line 34, or vice versa. Power entering the first waveguide port 32 is propagated along the first waveguide 12 to the transformers 26 and 28, and to the first slot 24. The propagated power is shorted out by the waveguide short-circuit 22, but currents are induced by the first slot 24 which is resonant at 6 gigahertz. These slot-currents radiate power into the cavity 20 which is also designed to resonate at 6 gigahertz.

The square coaxial TEM transmission line 14 is designed to conduct 6 gigahertz power, and is coupled to the cavity 20 for that purpose. Power is conducted from the cavity 20 to the transmission line port 34, where it can be fed to a load (not shown).

When power is conducted into the transmission line port 34, it is conducted to the shorted stub 30 where all frequencies are shorted out. A very high voltage standing wave ratio (VSWR) is created in the transmission line 14 adjacent to the first slot 24, which is located a predetermined integral number of quarter-wavelengths from the shorted end 30 of the transmission line 14. Power at 6 gigahertz is generated by the high VSWR in the resonant cavity 20, and coupled to the first waveguide 12 by the slot 24. Power is then propagated down the first waveguide 12 and out the waveguide port 32. The two stepped transformers 26 and 28 serve to match the impedance of the first waveguide 12 to the impedance of the first slot 24.

FIG. 3 shows another power coupler 40 according to a second embodiment of this invention. This coupler 40 is identical to the power coupler 10 described above, except that it includes a second waveguide 42 that is slot-coupled to the first waveguide 12. The second waveguide 42 is utilized to conduct electromagnetic energy having a frequency of 4 gigahertz to and from the first waveguide 12. This embodiment of the invention may be called a diplexer.

Figure 4:
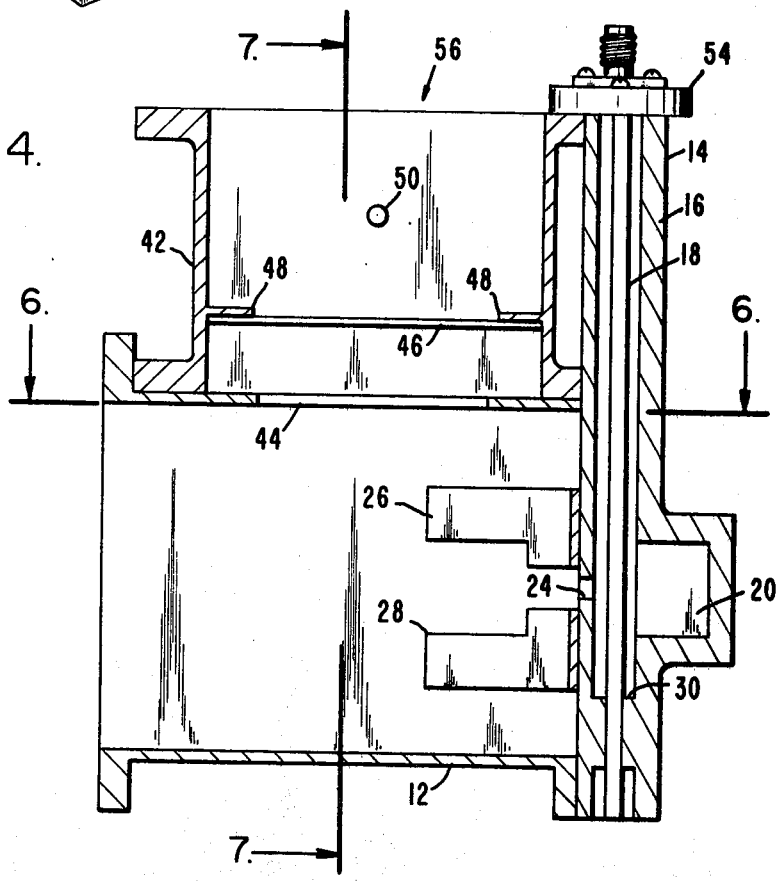
FIG. 4 is a sectional side view of the embodiment of this invention depicted in FIG. 3.
Figure 5:
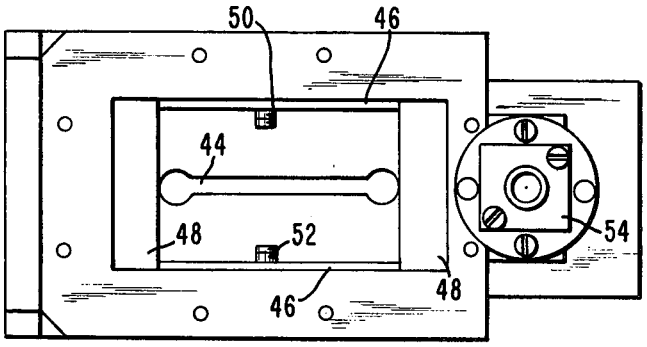
FIG. 5 is a top view of the embodiment of this invention depicted in FIG. 3.
Figure 7:
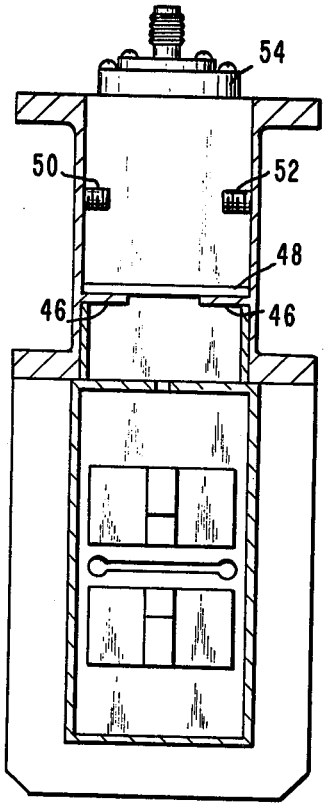
FIG. 7 is a sectional view of the second embodiment of this invention taken along line 7—7 of FIG. 4.

In FIG. 4, the second waveguide 42 is coupled to one of the narrow-walls of the first waveguide 12 by a second slot 44. The second waveguide has a longitudinal iris 46, an inductive iris 48, and two capacitive tuning screws 50 and 52, as shown in FIGS. 5 and 7.

Figure 6:
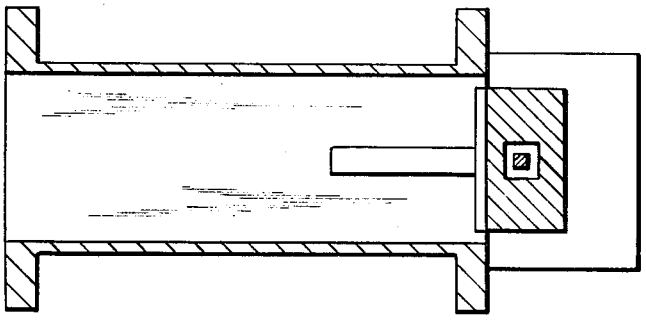
FIG. 6 is a sectional view of the second embodiment of this invention taken along line 6—6 of FIG. 4.

A square coaxial-to-coaxial wire transition device 54 is mounted at the transmission line port 34. FIG. 6 shows the cross-section of the transmission line in more detail.

The operation of the diplexer 40 is the same as described above for the power coupler 10 for coupling 6 gigahertz power between the first waveguide 12 and the transmission line 14. The second waveguide 42 enables power at 4 gigahertz to be coupled between the two waveguides. When power entering the first waveguide's port 32 is shorted at the waveguide short-circuit 22, a very high VSWR is created at integral quarter-wavelengths (at 4 gigahertz) from the short-circuit 22. The second slot 44 is oriented parallel to the axis of the first waveguide and its center is located an integral number of quarter-wavelengths (at 4 gigahertz) from the waveguide short-circuit 22. The high VSWR induces currents in the second slot 44, which resonates at its design frequency of 4 gigahertz, propagating power into the second waveguide 42. The longitudinal iris 46 and the inductive iris 48 serve to match the impedance of the second waveguide 42 to the impedance of the second slot 44. The capacitive tuning screws 50 and 52 are used for pass-band tuning. Power at 4 gigahertz then propagates along the second waveguide 42 to its input/output port 56.

Therefore, the diplexer 40 can couple 4 and 6 gigahertz power to their respective transmission lines from a common port, and vice versa. Of course, both embodiments of this invention can be modified by those skilled in the art to couple frequencies other than 4 and 6 gigahertz if the appropriate slots and dimensions are modified to suit the chosen frequencies. Further, the second waveguide 42 of the diplexer 40 can be coupled through either narrow-wall of the first waveguide 12. The first slot may be in a transverse orientation (as described) or in an inclined orientation. Various other changes may be made to the embodiments described above for various applications.

It is further understood that the above described embodiments are merely illustrative of the many possible specific embodiments which can represent applications of the principles of this invetion. Numerous and varied other arrangements can be devised in accordance with these principles by those skilled in this art without departing from the spirit or scope of the invention.

What is claimed is:

1. A microwave power coupler comprising:

a first waveguide means for propagating microwave power in a generally longitudinal direction, said first waveguide having parallel narrower walls and parallel wider walls;

an endwall serving as a short circuit for said first waveguide means, said endwall being located at one longitudinal end of said first waveguide means, said endwall having an elongated slot extending parallel to said narrower walls; and a coaxial transmission line extending adjacent said endwall, said coaxial transmission line including a resonator section in communication with said first waveguide through said slot.

2. The coupler of claim 1 further characterized in that said coaxial transmission line has a short circuit at one end.

3. The coupler of claim 1 further characterized in that said slot is adapted for transmitting only at about a first predetermined frequency.

4. The coupler of claim 1 further comprising a second waveguide means for propagating microwave power having one end thereof in communication with said first waveguide means through one of said narrow walls.

5. The coupler of claim 4 further characterized in that said waveguide means communicate through a second slot adapted for transmitting only at about a second predetermined frequency.

6. The coupler of claim 5 further characterized in that said first frequency is 6 GHz and said second frequency is 4 GHz.

7. A microwave diplexer comprising:

a first waveguide means for propagating microwave power in a generally longitudinal direction, said first waveguide means having parallel narrower walls and parallel wider walls;

a second waveguide means for propagating microwave power having one end thereof in communication with said first waveguide means through one of said narrow walls;

an endwall serving as a short circuit, said endwall being located at one longitudinal end of said first waveguide means, said endwall having an elongated slot extending parallel to said narrower walls; and a coaxial transmission line extending adjacent said endwall, said coaxial transmission line including a resonator section in communication with said first waveguide means through said slot.

8. The diplexer of claim 7 further characterized in that said coaxial transmission line has a short circuit at one end.

9. The diplexer of claim 7 further characterized in that said elongated slot is adapted for transmitting only at about a first predetermined frequency and said waveguide means communicate through a second slot adapted for transmitting only at about a second predetermined frequency.

10. The diplexer of claim 9 further characterized in that said first frequency is 6 GHz and said second frequency is 4 GHz.

* * * * *